US006056802A

United States Patent [19]

Kita et al.

[11] Patent Number: 6,056,802

[45] Date of Patent: May 2, 2000

[54] HIGH-STRENGTH ALUMINUM-BASED ALLOY

[75] Inventors: Kazuhiko Kita; Koji Saito, both of Sendai, Japan

[73] Assignee: YKK Corporation, Tokyo, Japan

[21] Appl. No.: 08/890,549

[22] Filed: Jul. 9, 1997

[30] Foreign Application Priority Data

Jul. 18, 1996 [JP] Japan ..... 8-189426

[51] Int. Cl.[7] ..... C22C 21/00

[52] U.S. Cl. ..... 75/249; 148/437; 148/438

[58] Field of Search ..... 75/249; 148/437–440

[56] References Cited

U.S. PATENT DOCUMENTS

| | | | |
|---|---|---|---|
| 5,593,515 | 1/1997 | Masumoto et al. | 148/437 |
| 5,858,131 | 1/1999 | Inoue et al. | 148/437 |

FOREIGN PATENT DOCUMENTS

| | | |
|---|---|---|
| 0 195 341 | 9/1986 | European Pat. Off. . |
| 0 534 470 | 3/1993 | European Pat. Off. . |
| 0 569 000 | 11/1993 | European Pat. Off. . |
| 0 577 944 | 1/1994 | European Pat. Off. . |
| 0 584 596 | 3/1994 | European Pat. Off. . |
| 1-275732 | 11/1989 | Japan . |
| 7-268528 | 10/1995 | Japan . |

OTHER PUBLICATIONS

Hua, M., et al., "A New Phase Related to Quasicrystals in Rapidly Cooled Al–Mn–Fe Alloys," Materials Research Bulletin, vol. 23, No. 1, Jan. 1988, pp. 87–90.

Van Tendeloo, G., et al., "Quasicrystals and their crystalline homologues in the Al–Mn–Cu ternary alloys," Philosophical Magazine A, vol. 64, No. 2, Aug. 1991, UK, pp. 413–427.

*Primary Examiner*—George Wyszomierski

*Attorney, Agent, or Firm*—Finnegan, Henderson, Farabow, Garrett & Dunner, L.L.P.

[57] ABSTRACT

A high-strength aluminum-based alloy consisting essentially of a composition represented by the general formula: $Al_{bal}Mn_aM_b$ or $Al_{bal}Mn_aM_bTM_c$ wherein M represents one or more members selected from the group consisting of Ni, Co, Fe and Cu, TM represents one or more members selected from the group consisting of Ti, V, Cr, Y, Zr, La, Ce and Mm and a, b and c each represent an atomic percent (at %) in the range of $2 \leqq a \leqq 5$, $2 \leqq b \leqq 6$ and $0 < c \leqq 2$ and containing monoclinic crystals of an intermetallic compound of an $Al_9Co_2$-type structure in the structure thereof. The Al-based alloy has excellent mechanical properties including a high hardness, high strength and high elongation.

5 Claims, 1 Drawing Sheet

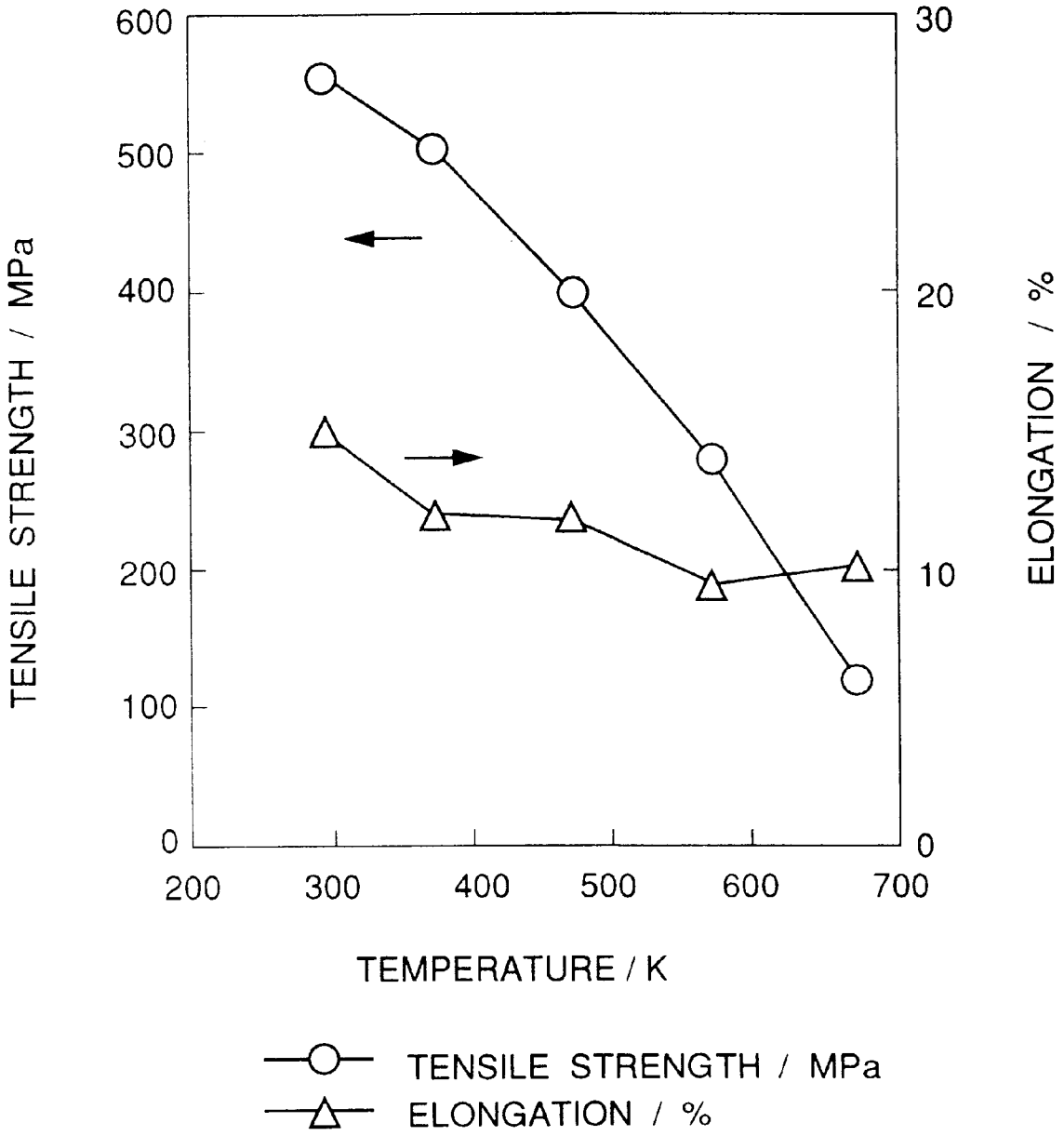
600
500
400
300
200
100
0
30
20
10
0
200
300
400
500
600
700
TENSILE STRENGTH / MPa
ELONGATION / %
TEMPERATURE / K
TENSILE STRENGTH / MPa
ELONGATION / %

HIGH-STRENGTH ALUMINUM-BASED ALLOY

BACKGROUND OF THE INVENTION

1. Field of the Invention

The present invention relates to an aluminum-based alloy having excellent mechanical properties including a high hardness, high strength and high elongation.

2. Description of the Prior Art

Aluminum-based alloys having a high strength and high thermal resistance are produced by a rapid solidification means such as a liquid quenching method. In particular, aluminum-based alloys obtained by the rapid solidification means disclosed in Japanese Patent Laid-Open No. 275732/1989 are amorphous or microcrystalline. Particularly the microcrystalline alloys disclosed therein comprise a solid solution comprising aluminum matrix or a composite comprising a metastable intermetallic compound phase. However, the ductility of the aluminum-based alloys disclosed in the above-described Japanese Patent Laid-Open No. 275732/1989 is yet insufficient and required to be improved, though these alloys are excellent alloys having a high strength and thermal resistance. Japanese Patent Laid-Open No. 268528/1995 discloses an aluminum-based alloy excellent in the thermal resistance, strength at room temperature, strength and hardness at a high temperature and ductility and having a high specific strength in virtue of its structure produced by finely dispersing at least quasi-crystals in aluminum matrix.

SUMMARY OF THE INVENTION

Under these circumstances, the object of the present invention is to provide an aluminum-based alloy excellent in strength and hardness and having a ductility and high specific strength by finely dispersing at least monoclinic crystals of an intermetallic compound of $Al_9Co_2$-type structure in a matrix comprising aluminum or a supersaturated solid solution of aluminum.

At first, the present invention provides a high-strength aluminum-based alloy consisting essentially of a composition represented by the general formula:

$$Al_{bal}Mn_aM_b$$

wherein M represents one or more members selected from the group consisting of Ni, Co, Fe and Cu, and a and b each represent an atomic percent (at %) in the range of $2 \leqq a \leqq 5$ and $2 \leqq b \leqq 6$ and containing monoclinic crystals of an intermetallic compound of an $Al_9Co_2$-type structure in the structure thereof.

Secondly the present invention provides also a high-strength aluminum-based alloy consisting essentially of a composition represented by the general formula:

$$Al_{bal}Mn_aM_bTM_c$$

wherein M represents one or more members selected from the group consisting of Ni, Co, Fe and Cu, TM represents one or more members selected from the group consisting of Ti, V, Cr, Y, Zr, La, Ce and Mm and a, b and c each represent an atomic percent (at %) in the range of $2 \leqq a \leqq 5$, $2 \leqq b \leqq 6$ and $0 < c \leqq 2$ and containing monoclinic crystals of intermetallic compound of $Al_9Co_2$-type structure in the structure thereof.

BRIEF DESCRIPTION OF THE DRAWING

The single FIGURE is a graph showing the results of measurements of the tensile strength and elongation of the material, obtained in Example 2, at room temperature and high temperatures.

DETAILED DESCRIPTION OF THE PREFERRED EMBODIMENTS

The monoclinic particles having the $Al_9Co_2$ structure are composed of three essential elements, Al, Mn and M in the present invention. When the amount of Mn and/or M is below the above-prescribed range, the intermetallic compound of the $Al_9Co_2$-type structure cannot be formed and, therefore, the degree of the strengthening is insufficient. On the contrary, when the amount of Mn is above the upper limit, the monoclinic particles and other intermetallic compound become coarse to reduce the ductility. M, as a constituent of the monoclinic crystals, contributes to the strengthening and, in addition, it is dissolved in the matrix to form the solid solution, thereby reinforcing the matrix. On the contrary, when the amount of M is above the upper limit, the intermetallic compound of the $Al_9Co_2$-type structure cannot be formed, and coarse intermetallic compounds are formed to seriously reduce the ductility. When the amount of M is smaller than that of Mn, the formation of the intermetallic compound of the $Al_9Co_2$-type structure becomes difficult to make the reinforcement insufficient. M, which is an element constituting the intermetallic compound of the $Al_9Co_2$-type structure, can be present also as the intermetallic compound phase and has a strengthening effect.

The monoclinic particle size of the intermetallic compound of the $Al_9Co_2$-type structure is desirably not larger than 10 $\mu$m, more desirably not larger than 500 nm. The volume fraction of the monoclinic crystals of the intermetallic compound of the $Al_9Co_2$-type structure is in the range of 10 to 80%.

As for the structure, it comprises the intermetallic compound of the $Al_9Co_2$-type structure and aluminum, or the intermetallic compound of the $Al_9Co_2$-type structure and a supersaturated solid solution of aluminum. The structure may further contain various intermetallic compounds formed from aluminum and other elements and/or intermetallic compounds formed from other elements. The presence of such an intermetallic compound is effective in reinforcing the matrix and controlling the crystal particles.

The elements Q (one or more elements selected from the group consisting of Mg, Si and Zn) are those usually used for forming aluminum alloys. Even when the elements Q are added in an amount of not larger than 2 at %, no bad influence is exerted on the properties of the aluminum alloys.

The aluminum-based alloy of the present invention can be obtained by rapidly solidifying a molten alloy consisting essentially of the above-prescribed composition by a liquid quenching process. The liquid-quenching process comprises rapidly cooling the molten alloy. For this process, a single-roller melt-spinning method, twin-roller melt-spinning method, in-rotating-water melt-spinning method or the like is particularly effective. By such a method, a cooling rate of about $10^2$ to $10^8$ K/sec is obtained. In the production of a thin ribbon material by the single-roller melt-spinning method, twin-roller melt-spinning method or the like, the molten metal is jetted against a roll made of copper, steel or the like, having a diameter of 30 to 300 mm and rotating at a predetermined rate in the range of about 300 to 10,000 rpm through a nozzle. By this technique, various thin ribbon materials having a width of about 1 to 300 mm and a thickness of about 5 to 500 $\mu$m can be easily obtained. When a fine wire material is to be produced by the in-rotating-water melt-spinning method, the molten metal is ejected through a nozzle against a solution refrigerant layer having a depth of about 1 to 10 cm kept by the centrifugal force in a drum rotating at about 50 to 500 rpm under argon gas back pressure to easily obtain the fine wire material. The angle formed by the molten metal ejected from the nozzle with the surface of the refrigerant is preferably about 60 to 90°, and the relative rate ratio of the ejected molten metal to the solution refrigerant surface is preferably about 0.7 to 0.9.

The methods are not limited to those described above, and a thin film can be formed by a sputtering method, and the rapidly solidified powder can be obtained by an atomizing method such as a high-pressure gas spraying method, or by a spraying method.

The alloy of the present invention can be obtained by the above-described single-roller melt-spinning method, twin-roller melt-spinning method, in-rotating-water melt-spinning method, sputtering method, various atomizing methods, spray method, mechanical alloying method, mechanical grinding method, mold casting method or the like. If necessary, the average crystal grain size of the matrix and the average particle size of the intermetallic compounds can be controlled. Throughout the specification, the terms "grain size" and "particle size" are used to mean "matrix grain size" and "intemetallic compound particle size", respectively.

In the present invention, a compacted and consolidated material can be produced by melting the material consisting essentially of a composition represented by the above general formula, rapidly solidifying it, compacting the resultant powder or flakes and consolidating the product by compression molding by an ordinary plastic processing means.

In this case, the powder or flakes used as the starting material must be in an amorphous structure, a supersaturated solid solution, a microcrystalline structure comprising intermetallic compounds having an average particle size of 10 to 1,000 nm or a mixed phase of them. When the starting material is amorphous, it can be converted into the microcrystalline or mixed phase structure satisfying the above-prescribed conditions by heating to 50 to 400° C. in the compacting step.

The term "ordinary plastic processing means" is used herein in a broad sense including the compression molding and powder metallurgy techniques.

The average crystal grain size and the dispersion state of the intermetallic compounds in the solidified aluminum-based alloy material of the present invention can be controlled by suitably selecting the production conditions. When greater importance is attached to the the strength, the average crystal grain size is controlled to be small; and when it is attached to the ductility, the average grain size and the average particle size of the intermetallic compound are controlled to be large. Thus, the products suitable for the various purposes can be obtained.

When the average crystal grain size is controlled in the range of 40 to 2,000 nm, excellent properties for the superplastic processable materials can be realized at a rate of strain in the range of $10^{-2}$ to $10^{2}$ $S^{-1}$.

The present invention will be further illustrated on the basis of the following concrete

EXAMPLE 1

An aluminum-based alloy powder having each predetermined composition was prepared at an average cooling rate of $10^3$ K/sec with a gas atomizer. The aluminum-based alloy powder thus prepared was fed into metal capsules. After degassing with a vacuum hot press, billets to be extruded were obtained. The billets were extruded with an extruder at a temperature of 300 to 550° C.

23 kinds of consolidated materials (extruded materials) each having a composition (at %) given in Table 1 were obtained under the above-described production conditions.

The tensile strength at room temperature, elongation at room temperature, Young's modulus (elastic modulus) and hardness of each of the consolidated materials obtained as described above were examined. The results are given in Table 1.

TABLE 1

| | Alloy (at %) | Strength (MPa) | Elongation (%) | Young's modulus (GPa) | Hardness (Hv) |
|---|---|---|---|---|---|
| 1 | $Al_{bal}Mn_4Ni_3$ | 722 | 8 | 91 | 210 |
| 2 | $Al_{bal}Mn_3Ni_4$ | 804 | 6 | 95 | 223 |
| 3 | $Al_{bal}Mn_2Ni_5$ | 775 | 6 | 95 | 219 |
| 4 | $Al_{bal}Mn_4Ni_2$ | 593 | 16 | 93 | 171 |
| 5 | $Al_{bal}Mn_3Ni_3$ | 667 | 13 | 93 | 190 |
| 6 | $Al_{bal}Mn_2Ni_4Cr_1Ti_{0.5}$ | 700 | 10 | 93 | 215 |
| 7 | $Al_{bal}Mn_3Ni_3Cr_1$ | 691 | 8 | 91 | 190 |
| 8 | $Al_{bal}Mn_2Ni_{3.5}Cr_1Zr_{0.5}$ | 839 | 5 | 91 | 232 |
| 9 | $Al_{bal}Mn_1Ni_4Cr_1$ | 721 | 12 | 87 | 197 |
| 10 | $Al_{bal}Mn_2Ni_3Cr_1V_1$ | 723 | 9 | 91 | 220 |
| 11 | $Al_{bal}Mn_3Ni_2Cr_1$ | 631 | 14 | 87 | 181 |
| 12 | $Al_{bal}Mn_2Co_2La_{0.5}$ | 623 | 14 | 90 | 177 |
| 13 | $Al_{bal}Mn_2Co_2La_{0.5}Mg_1$ | 635 | 12 | 91 | 182 |
| 14 | $Al_{bal}Mn_1Co_3Cr_1$ | 598 | 19 | 84 | 167 |
| 15 | $Al_{bal}Mn_4Co_3Y_{0.5}$ | 717 | 9 | 90 | 202 |
| 16 | $Al_{bal}Mn_4Co_3Y_{0.5}Si_1$ | 723 | 7 | 88 | 225 |
| 17 | $Al_{bal}Mn_3Co_3Ce_{0.5}$ | 673 | 8 | 92 | 196 |
| 18 | $Al_{bal}Mn_3Co_3Ce_{0.5}Zn_1$ | 692 | 6 | 90 | 201 |
| 19 | $Al_{bal}Mn_4Co_2Mm_1$ | 612 | 14 | 93 | 185 |
| 20 | $Al_{bal}Mn_3Ni_2Fe_1Cr_1$ | 681 | 14 | 94 | 192 |
| 21 | $Al_{bal}Mn_2Ni_2Fe_1Cr_2$ | 601 | 11 | 87 | 173 |
| 22 | $Al_{bal}Mn_3Ni_2Cu_1Cr_1$ | 702 | 9 | 94 | 193 |
| 23 | $Al_{bal}Mn_2Ni_2Cu_1Cr_2$ | 611 | 10 | 88 | 183 |

The facts described below are understood from the results given in Table 1. Namely, the consolidated material of the present invention has a tensile strength of as high as at least 593 MPa at room temperature, while a conventional high-strength aluminum alloy (Super Duralumin) available on the market has a tensile strength of 500 MPa. The elongation of the former at room temperature is as high as at least 5%, while the minimum elongation necessary for the usual processing is 2%. The Young's modulus (elastic modulus) of the former is as high as at least 84 GPa, while that of a conventional high-strength aluminum alloy (Duralumin) available on the market is about 70 GPa. In addition, since the consolidated material of the present invention has such a high Young's modulus, the deflection and deformation of the material are smaller than those of other materials advantageously when a given load is applied thereto. The hardness was examined with a Vickers microhardness meter under a load of 100 gf. It is apparent that the hardness (Hv) is as high as at least 167 DPN.

Test pieces for TEM observation were cut out of the consolidated material (extruded material) obtained under the above-described production conditions. The crystal grain size, intermetallic compound and particle size thereof were examined.

All the samples had such a structure that a compound of the monoclinic crystals of $Al_9Co_2$-type structure was finely dispersed in the matrix comprising aluminum or supersaturated solid solution of aluminum. The particle size of the monoclinic compound having the $Al_9Co_2$-type structure was not larger than 500 nm (10 to 500 nm).

EXAMPLE 2

An aluminum-based alloy powder having a composition of $Al_{95}Mn_2Cr_1Ni_2$ (at %) was prepared at an average cooling rate of $10^3$ K/sec with a gas atomizer. The aluminum alloy powder thus obtained was treated in the same manner as that of Example 1 to obtain a consolidated material (extruded material).

The tensile strength and elongation of the solidified material at room temperature and high temperatures were measured to obtain the results given in the figure.

The measurements were conducted at room temperature, 373 K (100° C.), 473 K (200° C.), 573 K (300° C.) and 673 K (400° C.). The tensile strength and elongation were measured while the temperatures were kept at the above-mentioned temperatures.

In view of the fact that the conventional high-strength aluminum alloy (Duralumin) available on the market has a tensile strength of 500 MPa at room temperature and that of 100 MPa at 573 K (300° C.), it is apparent that the alloy of the present invention is excellent in the high-temperature tensile strength and elongation as well as thermal resistance.

The TEM observation was conducted in the same manner as that of Example 1. It was found that the structure was the same as that of Example 1 and that the particle size of the monoclinic comound having the $Al_9Co_2$ type structure was also in the above-described range.

The alloy of the present invention is excellent in the hardness and strength at both room temperature and a high temperature and also in thermal resistance and elongation and has a high specific strength. The compacted and consolidated material prepared from the alloy is excellent in processability and usable as a structural material of which a high reliability is required.

What is claimed is:

1. A high-strength aluminum-based alloy consisting essentially of a composition represented by the general formula:

$$Al_{bal}Mn_aM_bTM_c$$

wherein M represents one or more members selected from the group consisting of Ni, Co, Fe and Cu, TM represents one or more members selected from the group consisting of Ti, V, Cr, Y, Zr, La, Ce and Mm and a, b and c each represent an atomic percent (at %) in the range of $2 \leqq a \leqq 5$, $2 \leqq b \leqq 4$ and $0 < c \leqq 2$ and containing 10 to 80% volume fraction monoclinic crystals of an intermetallic compound of an $Al_9Co_2$-type structure in the structure thereof, and wherein the high-strength aluminum-based alloy has a structure comprising the monoclinic crystals and aluminum, or the monoclinic crystals and a supersaturated solid solution of aluminum.

2. The high-strength aluminum-based alloy according to claim 1, which has an elongation of at least 5%.

3. The high-strength aluminum-based alloy according to claim 1, which further contains intermetallic compounds formed from one or more of Al, M, Mn, TM, and Q, Q being at least one element selected from the group consisting of Mg, Si and Zn.

4. The high-strength aluminum-based alloy according to claim 1, which is any of a rapidly solidified material, a heat-treated material obtained by heat-treating the rapidly solidified material or a compacted and consolidated material obtained by compacting and consolidating the rapidly solidified material.

5. The high-strength aluminum-based alloy according to claim 1, wherein the high-strength aluminum alloy further comprises 0 to 2 at. % of Q, Q being at least one element selected from the group consisting of Mg, Si and Zn.

* * * * *